US007150168B1

(12) United States Patent
Kuo

(10) Patent No.: US 7,150,168 B1
(45) Date of Patent: Dec. 19, 2006

(54) TUBULAR PIN TUMBLER LOCK UNIT

(76) Inventor: Lambert Kuo, No. 16, Lane 459, Sec. 1, An Ho Rd., Tainan (TW)

( * ) Notice: Subject to any disclaimer, the term of this patent is extended or adjusted under 35 U.S.C. 154(b) by 0 days.

(21) Appl. No.: 11/297,469

(22) Filed: Dec. 9, 2005

(30) Foreign Application Priority Data

Oct. 17, 2005 (TW) ..... 94136129 A

(51) Int. Cl.
*E05B 27/08* (2006.01)

(52) U.S. Cl. ..... 70/491; 70/404

(58) Field of Classification Search ..... 70/58, 70/409, 403, 404, 491, 389, 419
See application file for complete search history.

(56) References Cited

U.S. PATENT DOCUMENTS

| | | | | | |
|---|---|---|---|---|---|
| 95,509 | A * | 10/1869 | Petre | 70/134 |
| 989,484 | A * | 4/1911 | Campbell | 70/145 |
| 1,213,992 | A * | 1/1917 | Wright | 70/169 |
| 1,387,442 | A * | 8/1921 | Lee | 70/491 |
| 3,380,268 | A * | 4/1968 | Perrill | 70/491 |
| 4,112,820 | A * | 9/1978 | Conger et al. | 70/491 |
| 4,546,629 | A * | 10/1985 | Hwang | 70/491 |
| 4,653,297 | A * | 3/1987 | Moorhouse | 70/491 |
| 5,327,752 | A * | 7/1994 | Myers et al. | 70/58 |
| 5,349,835 | A * | 9/1994 | Liao | 70/491 |
| 2006/0117816 | A1 * | 6/2006 | Lee | 70/58 |

* cited by examiner

*Primary Examiner*—Lloyd A. Gall
(74) *Attorney, Agent, or Firm*—Hershkovitz & Associates; Abe Hershkovitz

(57) ABSTRACT

A tubular lock unit has a lock and key. An upper pin seat and a lower pin seat with multiple pins are respectively mounted in the lock. A shaft is inserted into the lower pin seat and connected to the upper pin seat. The upper pin seat has an annular keyway and a slot is defined in a sidewall. The key has a barrel and a protrusion extending out of the barrel. When the key is inserted into the keyway, the protrusion is inserted into the slot and a lower end of the protrusion meets with an upper end of the lower pin seat to rotate the upper pin seat. When an improper key is inserted into the keyway and rotated, at least one of the pins will remain extended into the upper pin seat to prevent rotation.

2 Claims, 5 Drawing Sheets

TUBULAR PIN TUMBLER LOCK UNIT

BACKGROUND OF THE INVENTION

1. Field of the Invention

The present invention relates to a tubular pin tumbler lock unit, and more particularly to a tubular lock that cannot be opened without a precisely corresponding tubular key.

2. Description of the Related Art

A conventional tubular pin tumbler lock unit comprises a tubular lock and a tubular key corresponding to the lock.

The tubular key has a handle and a barrel connected to the handle. Multiple cutouts are respectively defined in a lower periphery of the barrel and a lug extends out of a sidewall of the barrel.

The tubular lock has a cylinder, an upper pin seat, a lower pin seat, multiple upper pins, multiple lower pins, springs connected to a lower end of each lower pin, and a shaft extending out of a center of the lower pin seat. An annular keyway is defined axially in the upper pin seat and a slot is defined radially through the keyway.

The lower pin seat and the upper pin seat are respectively inserted into the cylinder and the keyway is exposed through a circular opening in an upper end of the cylinder. The lower pin seat is securely mounted in the cylinder and the upper pin seat is rotatably mounted on top of the lower pin seat. The upper pins are respectively received in the upper pin seat while upper portions of the lower pins are respectively received into the upper pin seat and lower portions of the lower pins are respectively received into the lower pin seat. An upper end of the shaft is connected to the upper pin seat thereby being rotatable by the upper pin seat.

When the key is not inserted into the keyway, the lower pins extend partially into the upper pin seat so that the upper pin seat cannot be rotated relative to the lower pin seat. When the key is inserted into the keyway, the cutouts are pressed against respective upper pins and push the pins downward so that the lower pins are substantially received into the lower pin seat. Interfacing surfaces between the lower pins and the upper pins align with interfacing surfaces between the lower pin seat and the upper pin seat. Hence, when the key is rotated, the upper pin seat and the connected shaft can rotate relative to the lower pin seat. Thereby a latch bolt connected to the shaft can be pivoted to lock or unlock.

However, a barrel-like object, which is similar to the key, can be inserted into the keyway to rotate the upper pin seat with force such that the conventional key unit can be easily unlocked.

Therefore, the invention provides a tubular lock unit to mitigate or obviate the aforementioned problems.

SUMMARY OF THE INVENTION

The main objective of the present invention is to provide a tubular lock unit with which it is secure and easy for a user to use.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
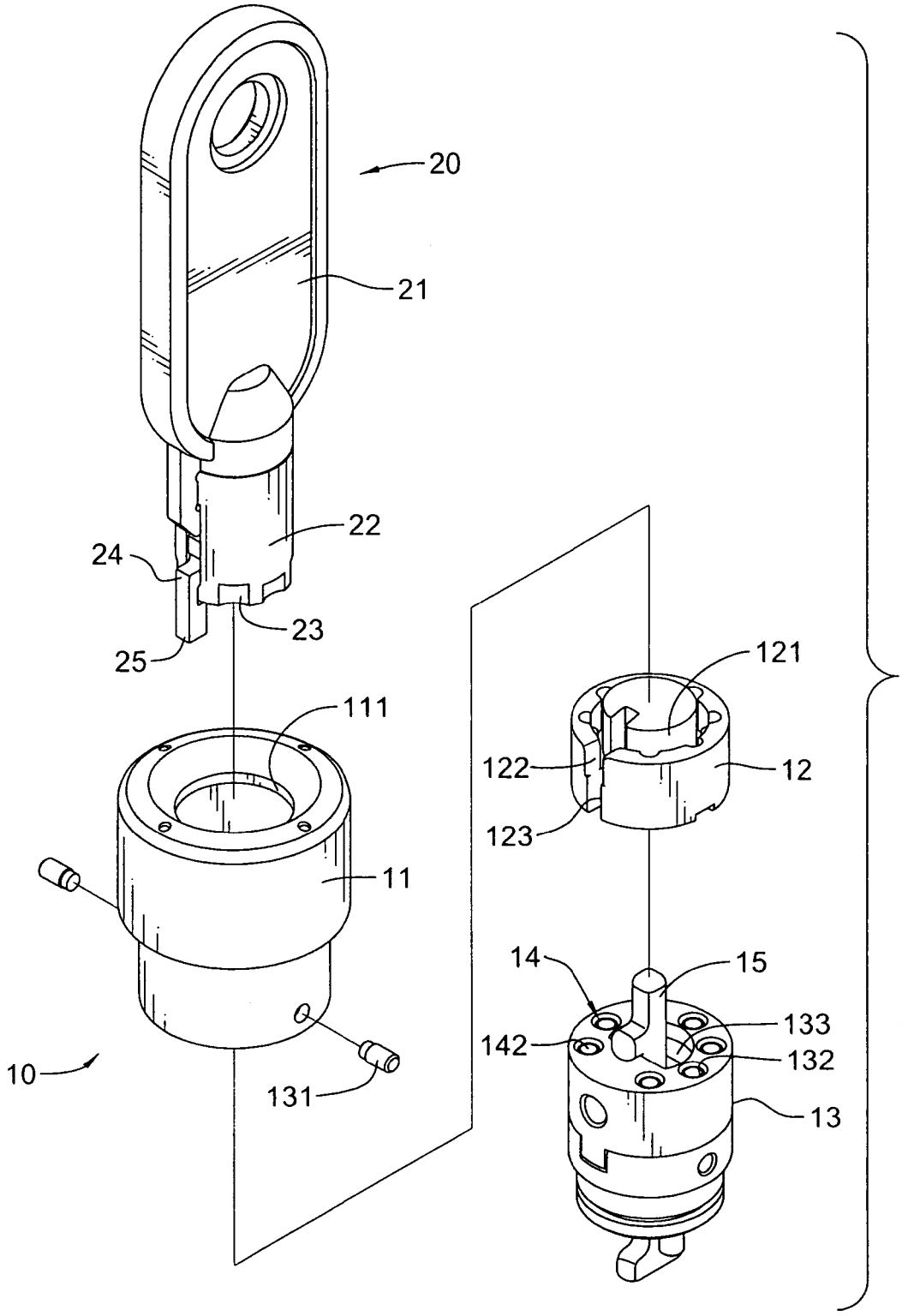
FIG. 1 is an exploded perspective view of a tubular lock unit in accordance with the present invention.
Figure 2:
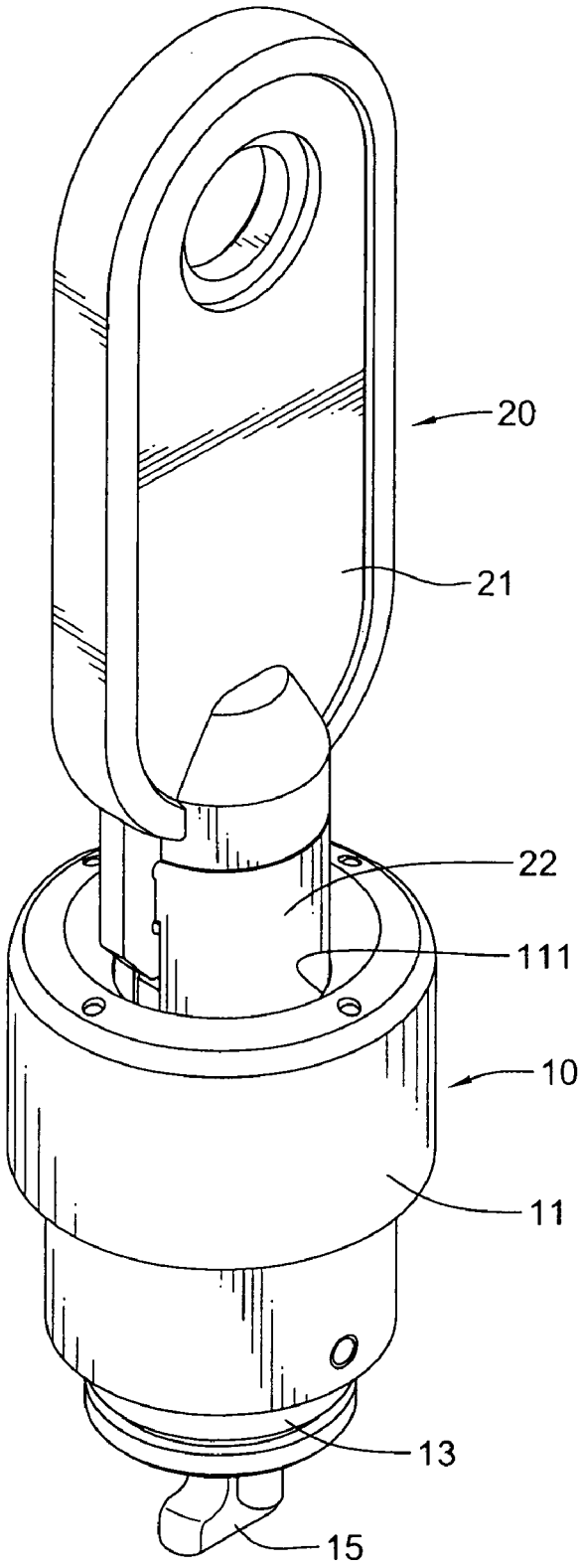
FIG. 2 is a perspective view of the tubular lock unit in FIG. 1.
Figure 3:
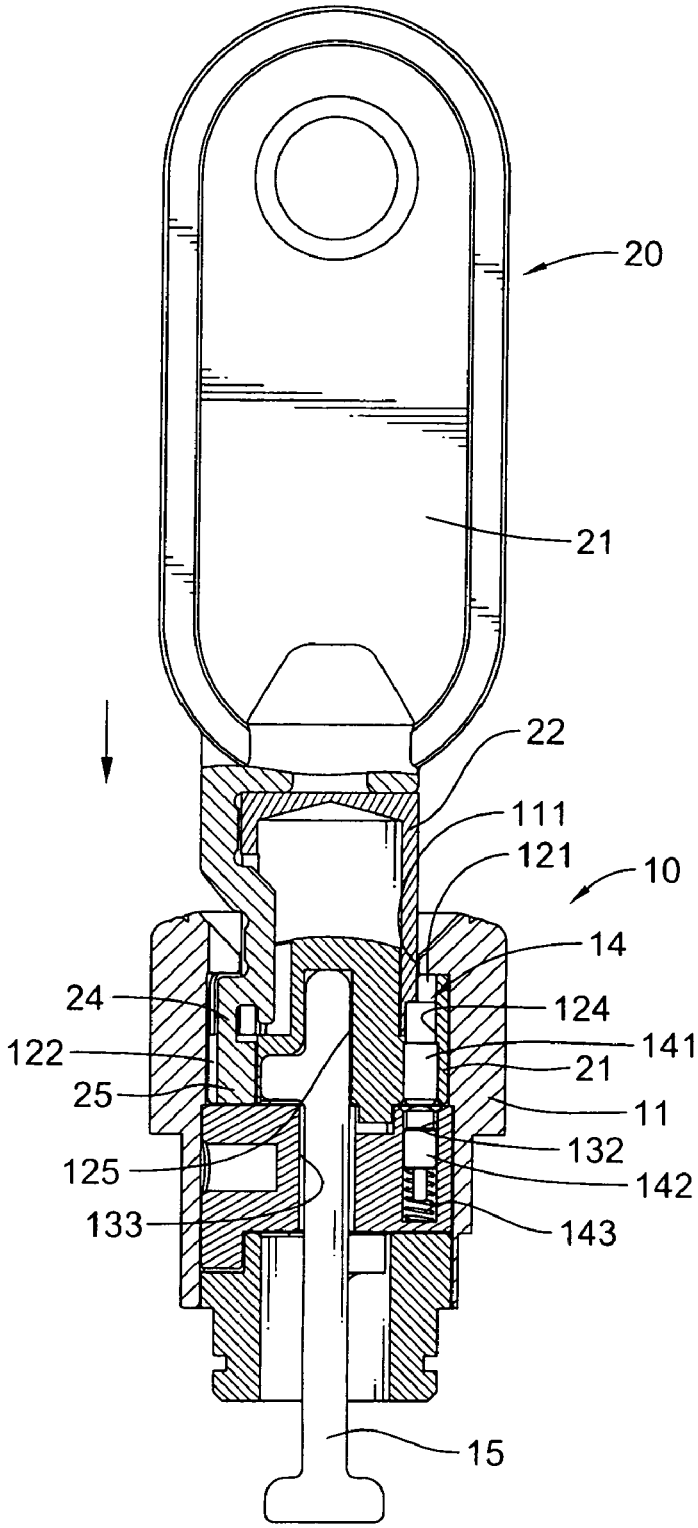
FIG. 3 is an operational side view in partial section of the tubular lock unit in FIG. 1 when a key is inserted into a keyway.
Figure 4:
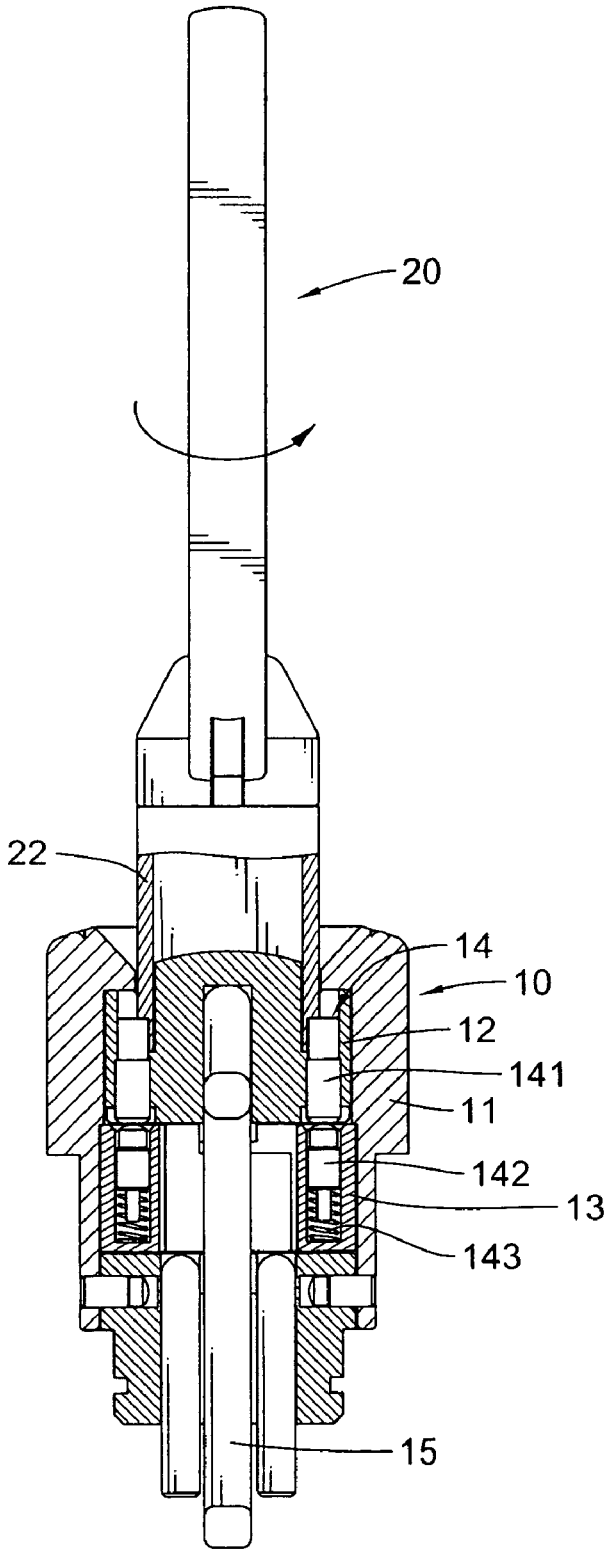
FIG. 4 is an operational side view in partial section of the tubular lock unit in FIG. 1 when the key is rotated.

With reference to FIGS. 1–3, a tubular lock unit in accordance with the present invention comprises a tubular lock (10) and a tubular key (20) corresponding to the lock (10).

The lock (10) has a cylinder (11), an upper pin seat (12), a lower pin seat (13), multiple pin groups (14) and a shaft (15).

The cylinder (11) has a hole (111) defined in a top end thereof.

The plug-like upper pin seat (12) has an axially defined annular keyway (121) and a slot (122) defined radially from an outer sidewall. The slot (122) extends from the outer sidewall to an inner sidewall of the upper pin seat (12) to define an open end (123) and is in communication with the keyway (121). Multiple upper pin openings (124) are defined radially and evenly along a wall of the keyway (121) and in communication with the keyway (121). An orifice (125) is defined axially in a lower end of the upper pin seat (12).

Multiple lower pin openings (132) are defined radially and evenly in the lower pin seat (13) and correspond to the upper pin openings (124). An aperture (133) is defined axially through the lower pin seat (13) and corresponds to the orifice in the upper pin seat (12).

The pin groups (14) have multiple upper pins (141), multiple lower pins (142), and multiple springs (143) connected to lower ends of the lower pins (142).

The key (20) has a handle (21) and a barrel (22) mounted at a free end of the handle (21). The barrel (22) has multiple cutouts (23) defined evenly around a lower periphery thereof, corresponding to the upper pin openings (124). A lug (24) is mounted longitudinally in a side of the barrel (22) and extends downward out of the barrel (22) to form a protrusion (25).

The shaft (15) has a latch bolt formed in a lower end thereof.

When assembled, the shaft (15) is moveably mounted in the aperture (133) of the lower pin seat (13) while an upper end of the shaft (15) extends out of the aperture (133). The upper pin seat (12) is rotatably mounted on top of the lower pin seat (13). The upper end of the shaft (15) is inserted into the orifice (125) and is rotatable with the rotation of the upper pin seat (12).

The upper pin seat (12) and the lower pin seat (13) are received into the cylinder (11) such that the keyway (121) is exposed through the hole (111) of the cylinder (11). The lower pin seat (13) is securely mounted in the cylinder (11) by pins (131) inserted through two holes in opposite sides of the cylinder (11) and the lower pin seat (13).

The slot (122) is positioned over at least one of the lower pin openings (132). In the preferred embodiment of the present invention, the lower pin openings (132) are defined evenly so the slot (122) can be easily positioned over a lower pin opening (132).

The upper pins (141) are respectively inserted into the upper pin openings (124) while the lower pins (142) with the springs (143) are partially inserted into both the upper pin openings (124) and the lower pin openings (132). Hence, the upper pin seat (12) cannot be freely rotated relative to the lower pin seat (13) and the latch bolt cannot be pivoted.

With further reference to FIGS. 1–4, when the key (20) is inserted into the keyway (121), the protrusion (25) is received into the slot (122) and the cutouts (23) are respectively pressed against the upper pins (141). When interfacing surfaces between the upper pins (141) and the lower pins (142) are aligned with interfacing surfaces between the upper pin seat (12) and the lower pin seat (13), a lower end of the protrusion (25) is parallel to an lower end of the upper pin seat (12) and pressed against an upper end of the lower pin seat (13) so that the key (20) cannot move downward any further. Hence, the key (20) can be turned to rotate the upper pin seat (12) and the shaft (15) to lock or unlock the latch bolt.

Figure 5:
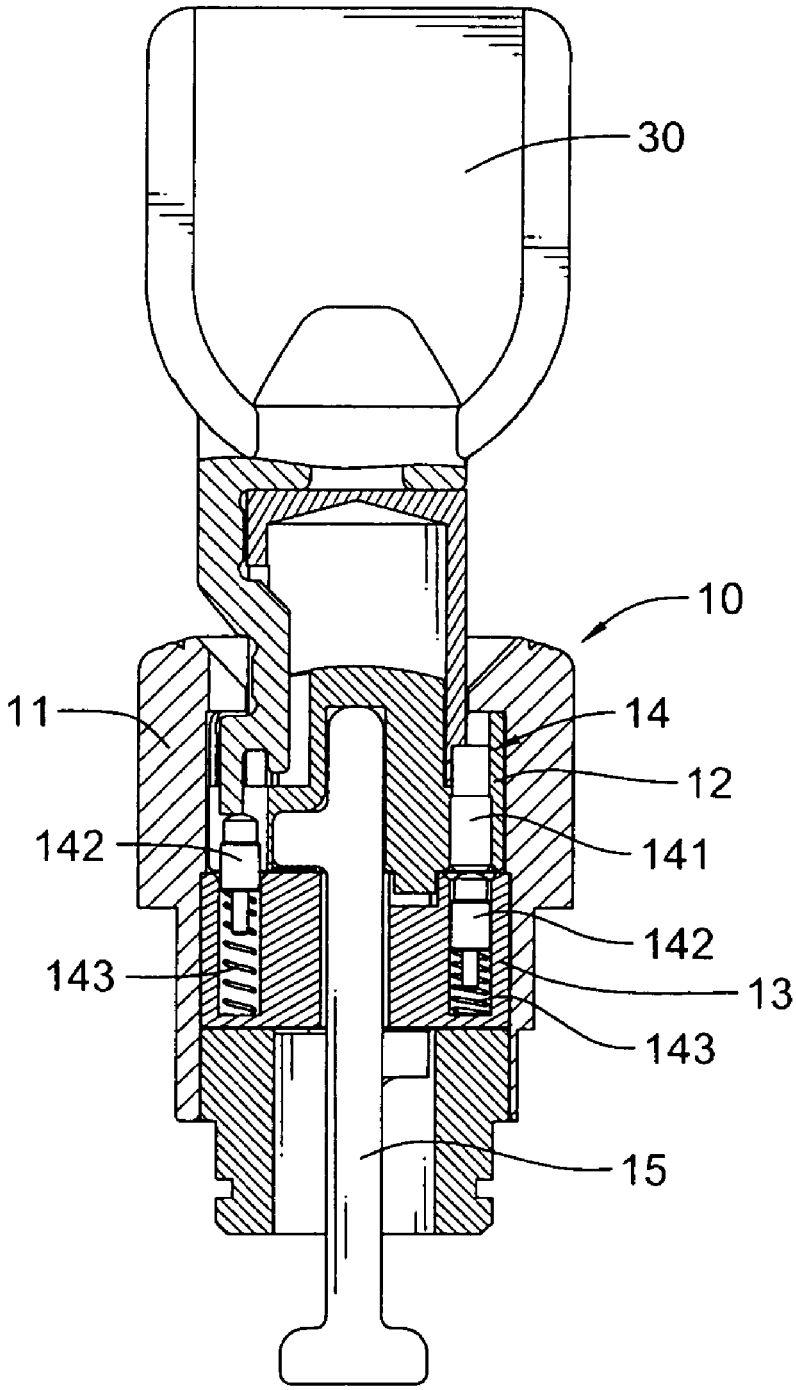
FIG. 5 is a side view in partial section of the tubular lock in FIG. 1 when an improper key is inserted into the keyway.

With reference to FIGS. 1 and 5, an improper key (30) without the protrusion (25) is inserted into the lock (10). The end of the protrusion (25) is not flush with the top of the lower pin seat (13). When the key (30) is rotated and the slot (122) moves over one of the lower pin openings (132), the lower pin (142) in this lower pin opening (132) is pushed by the spring (143) to move upward and partially extend into the slot (122) as the protrusion (25) is not long enough to prevent the lower pin (132) from rising. Hence, the upper pin seat (12) is stopped and cannot rotate any further.

Even if a pin or bar (not drawn in FIG. 5) is inserted into the slot (122), it is difficult to determine the correct length necessary to reach the lower end of the slot (122).

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tubular lock unit comprising:

a lock having a hollow cylinder with a hole in an end;

a lower pin seat securely mounted in the cylinder and having multiple lower pin openings defined evenly and radially therein;

an upper pin seat mounted rotatably in the cylinder and abutting an upper end of the lower pin seat and having an annular keyway defined axially in an upper end thereof, a slot defined radially in an outer sidewall and in communication with the keyway, and multiple upper pin openings defined evenly and radially in a sidewall of the keyway corresponding to the lower pin openings in the lower pin seat;

multiple lower pins inserted into the lower pin openings;

multiple upper pins inserted into the upper pin openings; and a shaft inserted into the lower pin seat and connected to the upper pin seat; and a key corresponding to the lock and having a barrel corresponding with the keyway and having a lug mounted longitudinally in a sidewall thereof, and a protrusion formed on an end of the lug and extending downward wherein when the protrusion is inserted into the slot, a lower end of the protrusion meets with an upper end of the lower pin seat.

2. The tubular lock unit as claimed in claim 1, wherein the slot extends radially in the upper pin seat to form an open end.

* * * * *